US007437856B2

(12) United States Patent
Berger, Jr.

(10) Patent No.: US 7,437,856 B2
(45) Date of Patent: Oct. 21, 2008

(54) SURFACE MOUNT WINDOW FOR DOORS

(76) Inventor: Allen Berger, Jr., 12195 NW. 98 Ave., Hialeah Gardens, FL (US) 33018

( * ) Notice: Subject to any disclaimer, the term of this patent is extended or adjusted under 35 U.S.C. 154(b) by 680 days.

(21) Appl. No.: 10/669,900

(22) Filed: Sep. 25, 2003

(65) Prior Publication Data

US 2005/0257454 A1 Nov. 24, 2005

Related U.S. Application Data

(63) Continuation of application No. 10/244,842, filed on Sep. 17, 2002, now Pat. No. 6,698,145, which is a continuation-in-part of application No. 10/201,762, filed on Jul. 23, 2002, now Pat. No. 6,763,638.

(51) Int. Cl.
*E06B 3/00* (2006.01)

(52) U.S. Cl. ..... 52/208; 52/455

(58) Field of Classification Search ..... 52/208, 52/455, 306, 786.1, 786.13; 114/177; 126/200
See application file for complete search history.

(56) References Cited

U.S. PATENT DOCUMENTS 2,052,244 A * 8/1936 Pertz ..... 52/786.13
2,172,469 A * 9/1939 Grigas ..... 126/220
2,177,001 A * 10/1939 Owen ..... 52/203
2,278,369 A 3/1942 Hall
2,356,878 A 8/1944 Painter
2,497,957 A * 2/1950 Pelley ..... 52/775
2,784,926 A * 3/1957 Bonza et al. ..... 244/129.3
3,248,273 A * 4/1966 Boicey ..... 428/38
3,375,626 A * 4/1968 Grotefeld et al. ..... 52/208
4,073,986 A 2/1978 Keslar et al.
4,228,425 A * 10/1980 Cooke ..... 340/550
4,364,533 A * 12/1982 Pompei et al. ..... 244/129.3
4,546,986 A 10/1985 Roselli
4,669,410 A * 6/1987 Howell ..... 114/173
4,719,728 A * 1/1988 Eriksson et al. ..... 52/172
4,873,803 A * 10/1989 Rundo ..... 52/202
D304,572 S * 11/1989 Beckerer, Jr. ..... D12/317
4,947,597 A 8/1990 Simpson ..... 52/208
5,035,096 A 7/1991 Ohtake et al. ..... 20/208
5,373,672 A 12/1994 Schulz ..... 52/208 X
5,497,588 A * 3/1996 Martin et al. ..... 52/208
5,577,355 A 11/1996 Leonelli
5,950,398 A * 9/1999 Hubbard ..... 52/786.1
6,082,674 A * 7/2000 White et al. ..... 244/129.3
6,101,783 A * 8/2000 Howes ..... 52/786.11
6,237,306 B1 * 5/2001 Dlubak ..... 52/786.11
6,276,100 B1 * 8/2001 Woll et al. ..... 52/204.62
6,280,826 B1 8/2001 Woll et al.

(Continued)

*Primary Examiner*—Robert J Canfield
*Assistant Examiner*—Christine T Cajilig
(74) *Attorney, Agent, or Firm*—Sanchelima & Assoc., P.A.

(57) ABSTRACT

A window assembly for garage doors having an opening with cooperative dimensions to receive a transparent panel with a reduced surface on one side and a peripheral flange making the outer surface larger than the internal surface. The underside of the peripheral flange member comes in abutting contact with the panel's external surface to which it is glued. An external frame member is mounted over the peripheral edge of the external side of the transparent panel. An internal frame member is mounted over the peripheral edge of internal surface. Fastening members are used to keep the transparent panel member in place.

2 Claims, 2 Drawing Sheets

U.S. PATENT DOCUMENTS 6,555,202 B2 4/2003 Shukuri et al.
6,569,787 B1 5/2003 Snelling
6,698,145 B2 * 3/2004 Berger, Jr. ..... 52/208
6,708,595 B1 * 3/2004 Chaussade et al. ..... 89/36.02
6,763,638 B1 * 7/2004 Berger, Jr. ..... 52/204.6

* cited by examiner

SURFACE MOUNT WINDOW FOR DOORS

OTHER RELATED APPLICATIONS

The present application is a continuation of application Ser. No. 10/244,842 filed on Sep. 17, 2002, now U.S. Pat. No. 6,698,145 which in turn is a continuation-in-part of the U.S. patent application Ser. No. 10/201,762, filed on Jul. 23, 2002 now U.S. Pat. No. 6,763,638 for Window Assembly for Opening Closures, which is hereby incorporated by reference.

BACKGROUND OF THE INVENTION

1. Field of the Invention

The present invention relates to a surface mount window for doors, and more particularly, for garage doors.

2. Description of the Related Art

Many designs for garage door windows have been designed in the past. None of them, however, includes a resistant and simple configuration as in the present application. The applicant has reduced the number of components of the embodiments for the invention subject of the parent application to a minimum. This distillation resulted in the most economical configuration for garage window doors that can still withstand considerable wind loads.

Window assemblies are typically mounted on panels. They are designed to enhance the aesthetic appeal of the closures (doors) while permitting daylight to go through. However, the window assemblies used in conventional garage doors include frames that cannot withstand high winds, such as those that develop in certain areas, such as South Florida. Local construction codes include wind tests that require reinforcement of these window assemblies and many times these added structures detract from the aesthetics of the window design. Garage doors, for instance, typically include a number of hingedly connected panels that are moved from a vertical position to a horizontal overhead position over tracks. The conventional window assemblies in these doors fail to meet these tests. Thus, the desirability of a sturdier structure but without including costly components.

The advantages of the present invention, as it will be more fully explained in the following paragraphs, include a simple window assembly that can be readily installed around the edges of the aperture defining the window. The assembly is thus capable of retaining the transparent panel while absorbing the impact energy of high winds and flying objects.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a window assembly that can be readily mounted through an opening in a garage door panel having cooperative dimensions.

It is another object of this invention to provide a window assembly that can withstand high wind loads.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
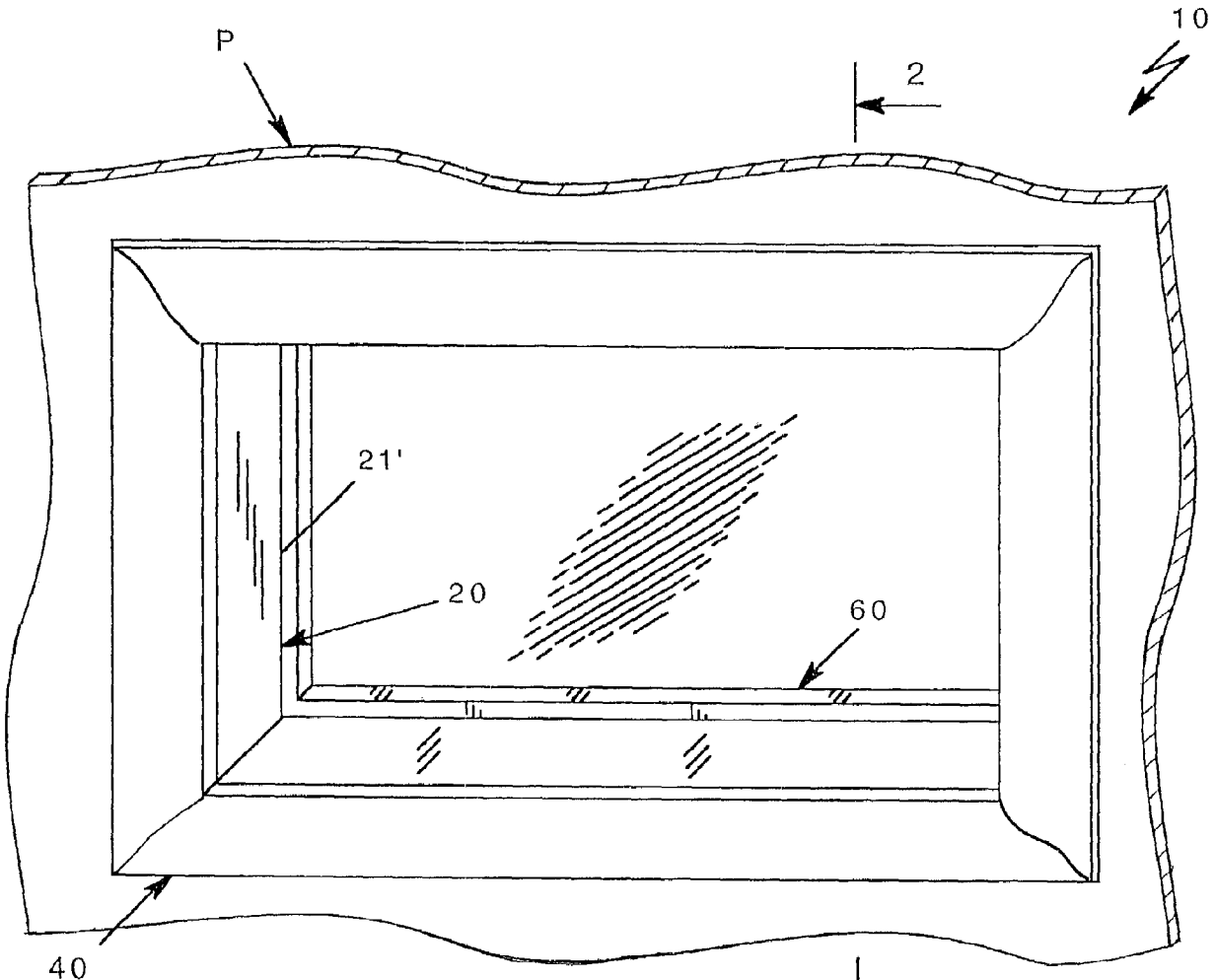
FIG. 1 represents an isometric view of one of the preferred embodiments for surface mount window for doors, object of the present invention.
Figure 2:
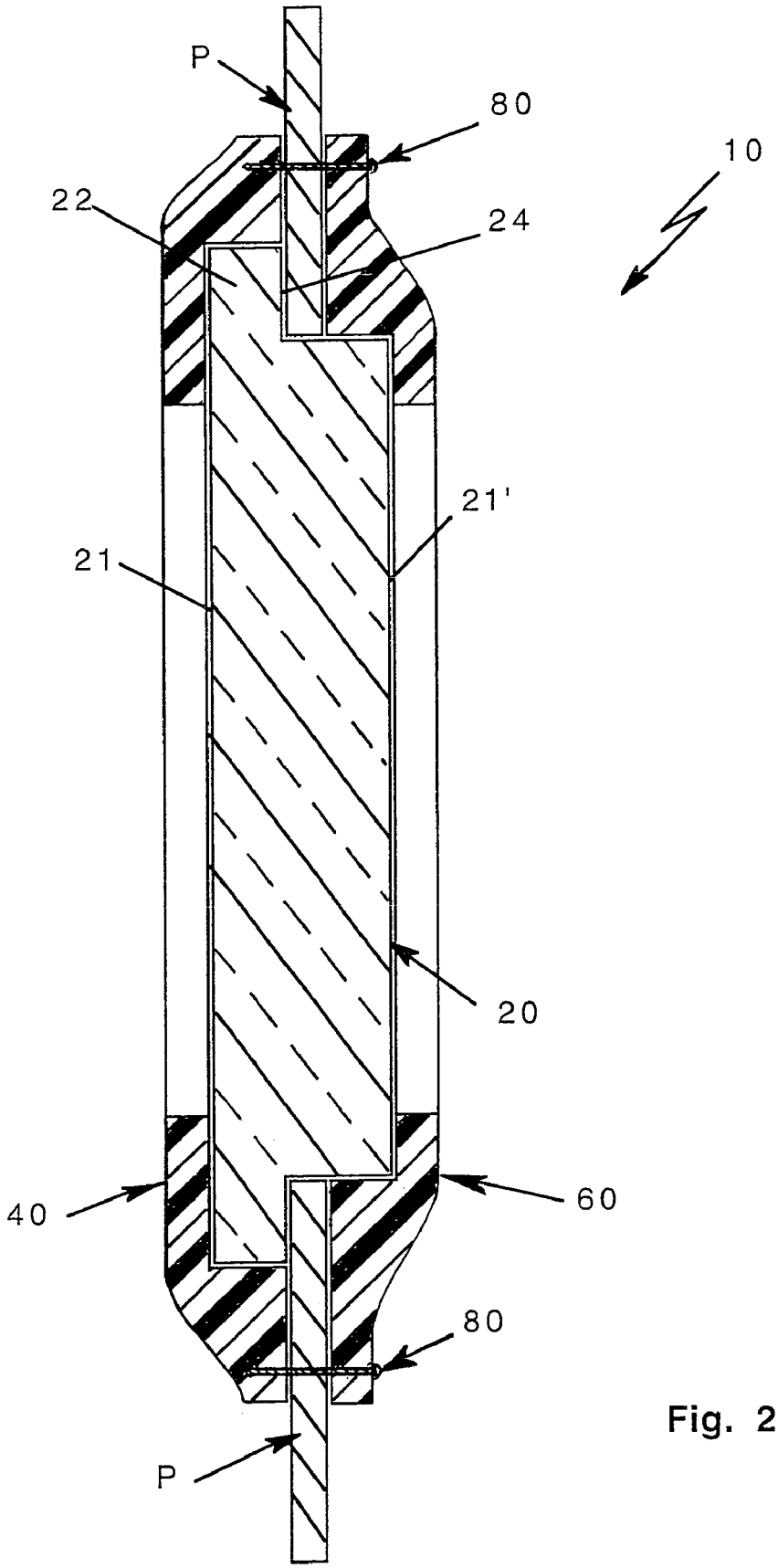
FIG. 2 illustrates a cross-sectional view taken along line 2-2 in FIG. 1.

Referring now to the drawings, where the present invention is generally referred to with numeral 10, it can be observed that it basically includes transparent panel 20, external frame assembly 40, internal frame assembly 60 and fastening members 80. Transparent panel 20 has external surface 21 and internal surface 21', the latter being smaller than the former. Transparent panel 20 has a peripheral flange 22 defining peripheral underside surface 24 that comes in abutting contact with the external surface of panel P. An opening in panel P has cooperative dimensions to receive through internal surface 21'.

Surface 24 is kept against the outer surface of panel P through different methods. One is by using an adhesive (like epoxies). Another method is by using fastening members 80.

External and internal frame assemblies 40 and 60 are mounted over external and internal peripheral the edges of external and internal surfaces 21 and 21', respectively, covering the latter. Frame assemblies 40 and 60 may also provide a mass for receiving fastening members 80 further securing transparent panel 20 in place. Or, assemblies 40 and 60 that can be used merely for ornamental purposes; if desired.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A window assembly for garage doors, comprising:

A) a transparent panel consisting of one pane having an external surface and an internal surface, said external surface including a coplanarly extending peripheral flange member making said external surface larger than said internal surface with respective external and internal peripheral edges, and said peripheral flange member further including a peripheral underside surface that comes in abutting contact against the peripheral external surface adjacent to and outside an opening in a garage door panel with cooperative dimensions to permit said internal surface to pass through and beyond said opening; and B) means for mounting said transparent panel on said garage panel.

2. The window assembly set forth in claim 1 wherein said means for mounting said transparent panel on said garage panel includes:

C) an external frame assembly mounted on said garage panel around said external peripheral edge.

* * * * *